US011266223B2

(12) United States Patent
Chiu et al.

(10) Patent No.: US 11,266,223 B2
(45) Date of Patent: Mar. 8, 2022

(54) BACKPACK THAT EMPLOYS A STRAP FASTENER TO SECURE UTENSILS IN PLACE

(71) Applicant: 10741841 CANADA INC, Toronto (CA)

(72) Inventors: Keith Chiu, Markham (CA); Philip Lee, Toronto (CA)

(73) Assignee: 18741841 Canada Inc, Toronto (CA)

( * ) Notice: Subject to any disclaimer, the term of this patent is extended or adjusted under 35 U.S.C. 154(b) by 0 days.

(21) Appl. No.: 16/802,912

(22) Filed: Feb. 27, 2020

(65) Prior Publication Data

US 2021/0267356 A1 Sep. 2, 2021

(51) Int. Cl.
*A45F 3/04* (2006.01)
*A45F 3/00* (2006.01)

(52) U.S. Cl.
CPC ..... *A45F 3/04* (2013.01); *A45F 2003/003* (2013.01); *A45F 2200/05* (2013.01)

(58) Field of Classification Search
CPC .. A45F 3/04; A45F 2003/003; A45F 2200/05; A45F 2200/0575; A45C 7/0054; A45C 7/0095; A45C 2007/0004
USPC ..... 224/650–652, 682, 684, 232
See application file for complete search history.

(56) References Cited

U.S. PATENT DOCUMENTS 4,498,615 A * 2/1985 Johnson ..... A63B 57/203 224/274
5,586,703 A * 12/1996 Radar ..... A45F 3/04 224/148.2
6,659,320 B1 * 12/2003 Alves ..... A45C 7/0086 224/581
6,889,689 B1 * 5/2005 Neuman ..... A61M 16/0683 128/201.22
2008/0029562 A1 * 2/2008 Hawkins ..... A45F 3/04 224/153
2008/0156604 A1 * 7/2008 Franco ..... B60R 7/00 190/1

* cited by examiner

*Primary Examiner* — Scott T McNurlen
(74) *Attorney, Agent, or Firm* — Tatonetti IP

(57) ABSTRACT

A backpack having multiple pouches on an inside flap can have a fastener which horizontally extends across the flap and which secures kitchen utensils, such as knives, in place. The flap can have multiple aligned pouches which extend laterally across a bottom portion of the flap. A distance above the flaps is a base fastener which extends on a base from one lateral end of the flap to the opposite lateral end. When the handles of kitchen utensils, such as knives, are placed inside respective pouches, the sharpened section of each knife is at least partially exposed. A strap fastener is attached at one lateral end of the flap and removably engages with the base fastener. The strap fastener secures the knives in place by overlapping with the knives and engaging with the exposed portions of the base fastener.

9 Claims, 7 Drawing Sheets

BACKPACK THAT EMPLOYS A STRAP FASTENER TO SECURE UTENSILS IN PLACE

CROSS-REFERENCE TO RELATED APPLICATIONS

This non-provisional utility application hereby incorporates by reference the entire disclosure of non-provisional design application Ser. No. 29/725,796, filed contemporaneously herewith, entitled Backpack Flap with Strap.

BACKGROUND

Cooking enthusiasts and chefs may have various kitchen utensils, such as knives, wooden spoons, etc., which they can carry around in a backpack made specifically for holding kitchen utensils. The carrier of the fully loaded backpack may be displeased if the utensils are moving around and/or escaping the pouches in which they are placed.

SUMMARY

A backpack having multiple pouches on an inside flap can have a fastener which horizontally extends across the flap and which secures kitchen utensils, such as knives, in place. The flap can have multiple aligned pouches which extend laterally across a bottom portion of the flap. A distance above the flap is a base fastener which extends on a base from one horizontal end of the flap to the opposite horizontal end. When the handles of kitchen utensils, such as knives, are placed inside respective pouches, the sharpened section of each knife is at least partially exposed. The sharpened portions of the knives may overlap with the base fastener.

A strap fastener is attached at one horizontal end of the flap and removably engages with the base fastener. The strap and base fasteners may be, for example, hook-and-loop fasteners (e.g., Velcro®). The strap fastener secures the knives in place by overlapping with the knives and engaging with the exposed portions of the base fastener, that is, the portions of the base fastener which are not covered by the knives. When the fasteners are engaged, the knives are secured in place which prevents or reduces movement and the possibility of escape from the pouches.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Furthermore, the claimed subject matter is not limited to implementations that solve any or all disadvantages noted in any part of this disclosure. These and various other features will be apparent from a reading of the following Detailed Description and a review of the associated drawings.

DESCRIPTION OF THE DRAWINGS

Like reference numerals indicate like elements in the drawings. Elements are not drawn to scale unless otherwise indicated.

DETAILED DESCRIPTION

Figure 1:
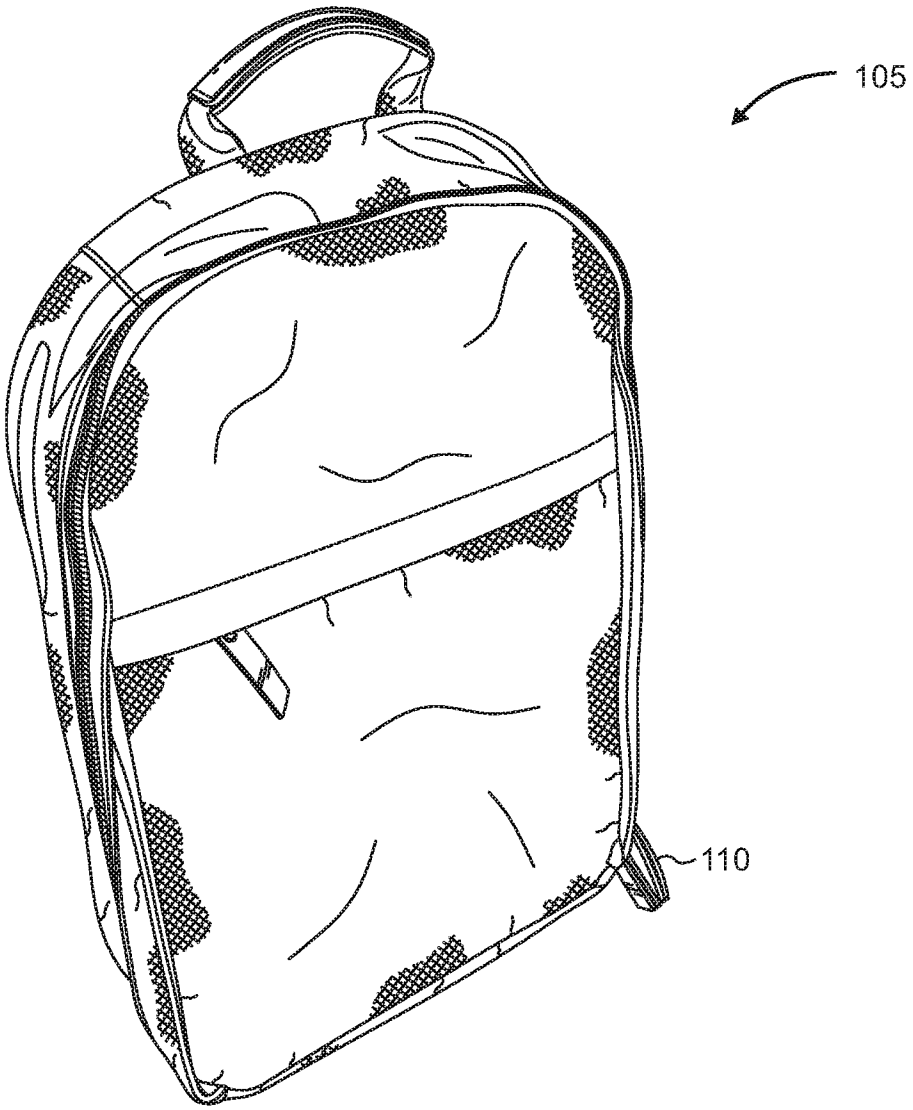
FIG. 1 shows an illustrative representation of a backpack.

FIG. 1 shows an illustrative representation of a backpack 105 which may be used to hold various items. In this implementation, the backpack is configured with various internal compartments and features to hold kitchen utensils, such as knives, silverware, wooden spoons, knife sharpers, etc. The zipper 110 can be used to open the backpack.

Figure 2:
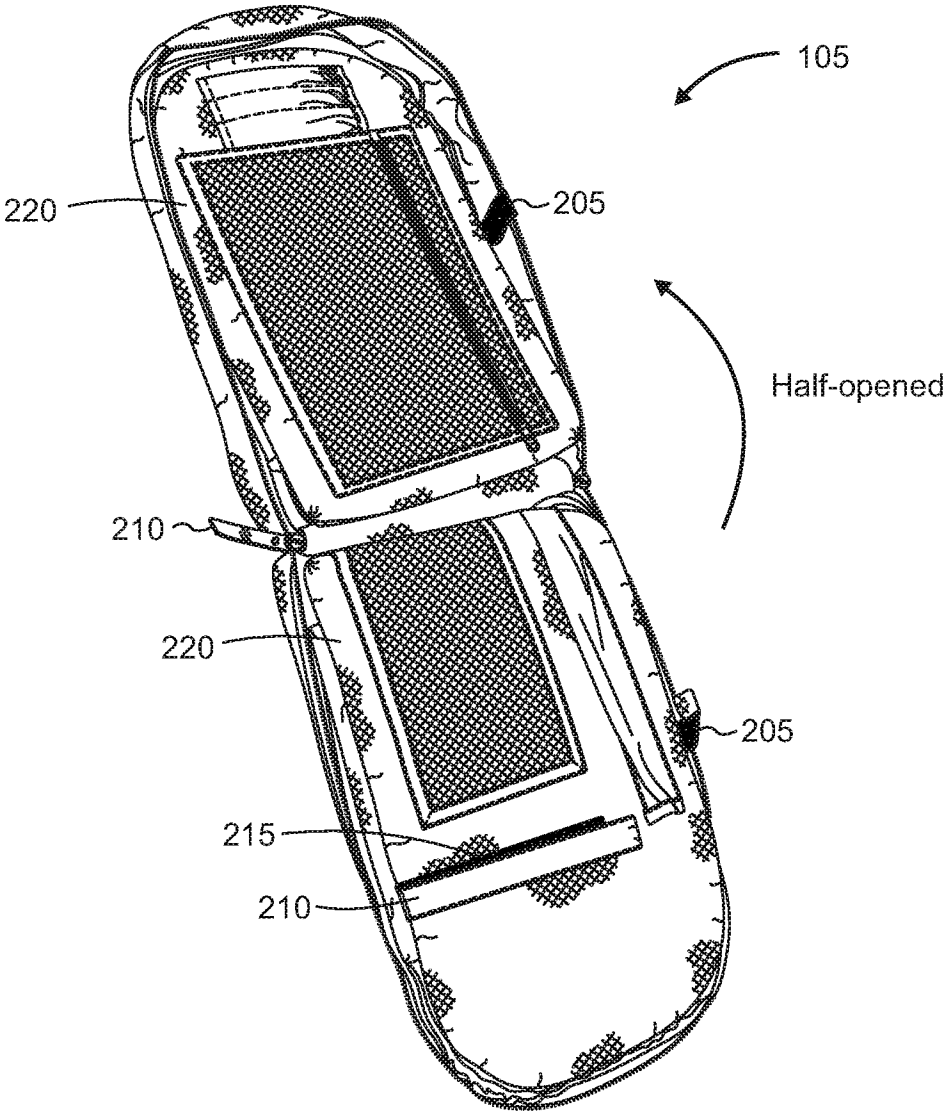
FIG. 2 shows an illustrative representation of the backpack in a half-opened position.

FIG. 2 shows an illustrative representation in which the backpack 105 is in the half-opened position after a user unzipped the zipper 110. The fabric of the outer and internal backpack components may be, for example, nylon, such as fortified ballistic nylon, to provide sufficient strength and durability to store various kitchen utensils. As shown and discussed in greater detail below, the backpack includes a strap fastener 210 and a base fastener 215 with which the strap fastener engages. On the reverse sides of the flaps 220 are additional respective strap fasteners 205 which extend past the respective flaps. The configuration and use of the fasteners will be discussed in greater detail below.

Figure 3:
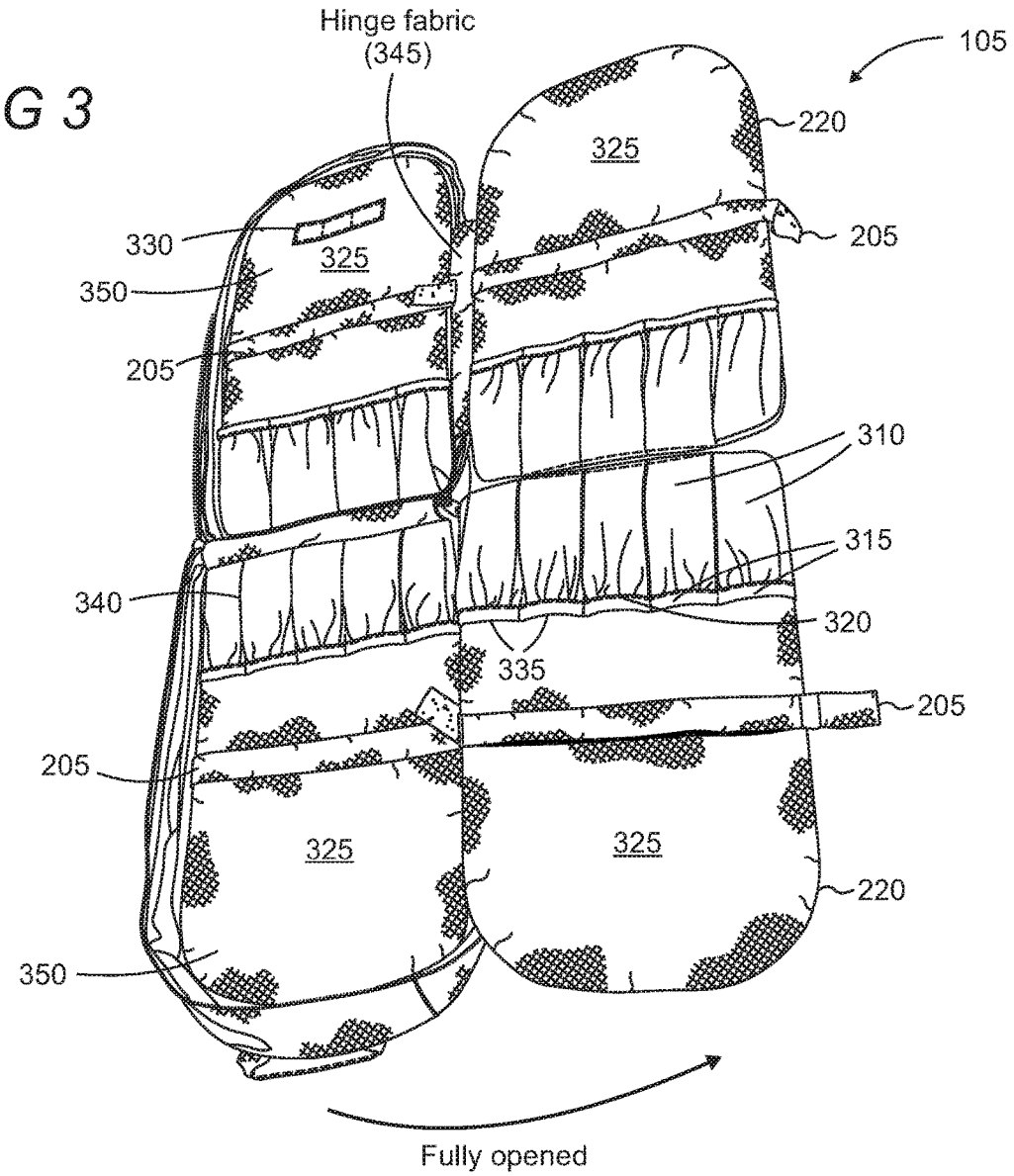
FIG. 3 shows an illustrative representation of the backpack in a fully opened position.

FIG. 3 shows an illustrative representation in which the backpack 105 is in a fully opened position once the flaps 220 are half-rotated laterally about the hinge fabric 345, as illustratively represented by the arrow. In this regard, the flaps 220 may be considered movable flaps since they rotate about the hinge fabric to provide access to the additional backpack compartments. The hinge fabric 345 may be a piece of fabric, such as nylon fabric, that connects the flaps 220 to the backpack's frame or to the stagnant flaps 350. Opposite horizontal ends of the hinge fabric may be respectively attached to the stagnant flap and the movable flap.

The stagnant flaps 350 may be configured similarly to the flaps 220, but the stagnant flaps are attached to the inside frame of the backpack and, in this implementation, do not rotate or move. In other implementations, the stagnant flap may likewise rotate laterally, such as in the opposite direction of the movable flaps 220. Discussion regarding the configuration of the flap 220 (e.g., fasteners, pouches, etc.) likewise applies to the stagnant flaps 350.

Each movable flap 220 and stagnant flap 350 has a base 325 which forms the linear plane for the compartments and components attached to the flaps. Pouches 310 are attached (e.g., stitched) to the base 325 of the flaps for storage of various kitchen utensils using the openings 335 at the top of the pouches. Each pouch is separated at a seam 340 so each kitchen utensil has its own space. Elastic tops 315 for the pouches are provided to better secure and put pressure on kitchen utensils stored within the pouches. The elastic tops are secured to the pouches using the seam 320. The elastic tops also provide greater protection to the pouches since the tops of the pouch will likely be engaged more frequently through use.

A distance above the pouches 310 are strap fasteners 205 which are secured to each respective flap 220 at a horizontal end. The strap fasteners may be fastened at the attachment point between the flap 220 and the hinge 345. Thus, the strap fastener may be sewed in between the hinge fabric, which enables rotatability of the flap 220, and the flap 220. This may enhance the strength of the strap fastener to the flap for repeated use.

In some implementations, such as for the stagnant flap 330, an elastic support strap 330 can be utilized and through which a kitchen utensil can extend to provide some reinforced support. Thus, for example, a long utensil may be placed inside a pouch 310, be secured by the strap fastener 205, and then an upper portion of the utensil can be secured via the elastic support strap 330.

Figure 4:
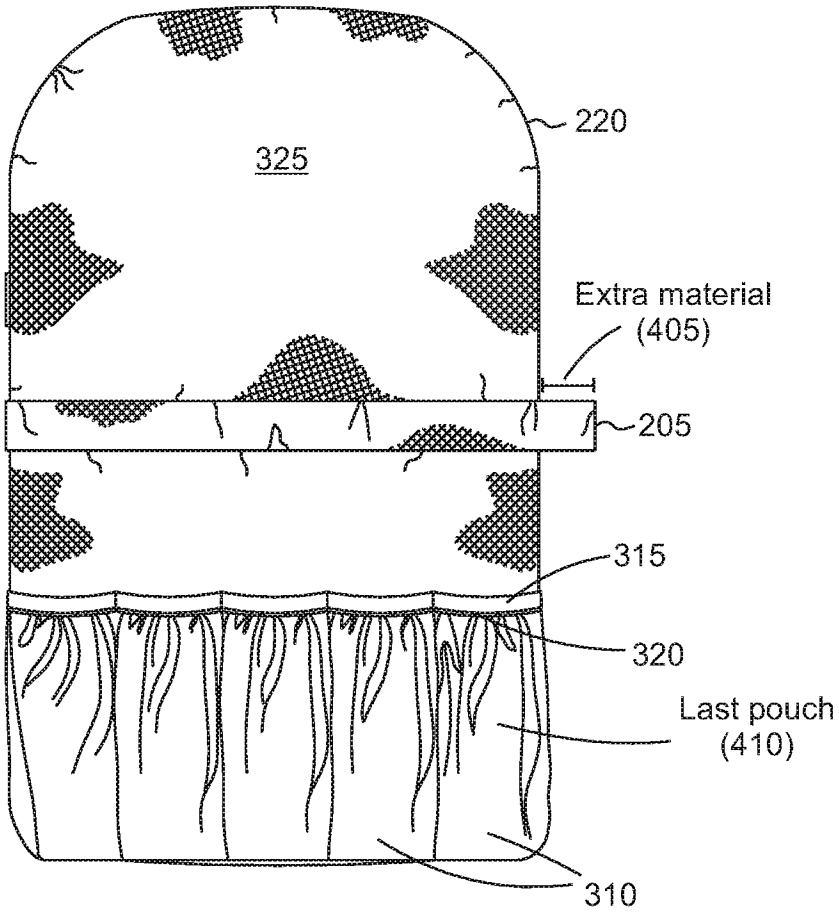
FIG. 4 shows an illustrative representation of an individual flap on the backpack having a strap fastener.
Figure 5:
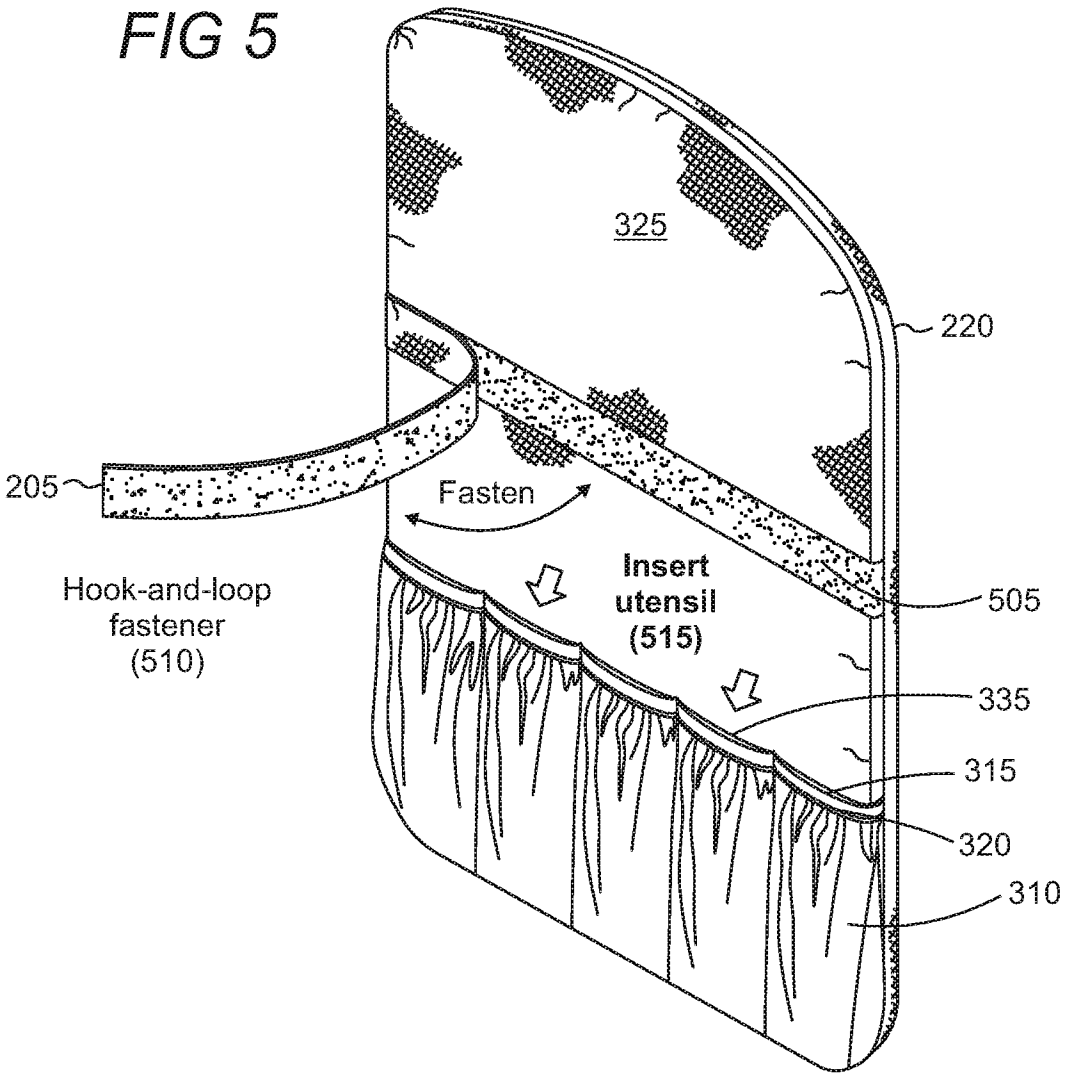
FIG. 5 shows an illustrative representation of the strap lifted from the base fastener on the base of the flap.
Figure 6:
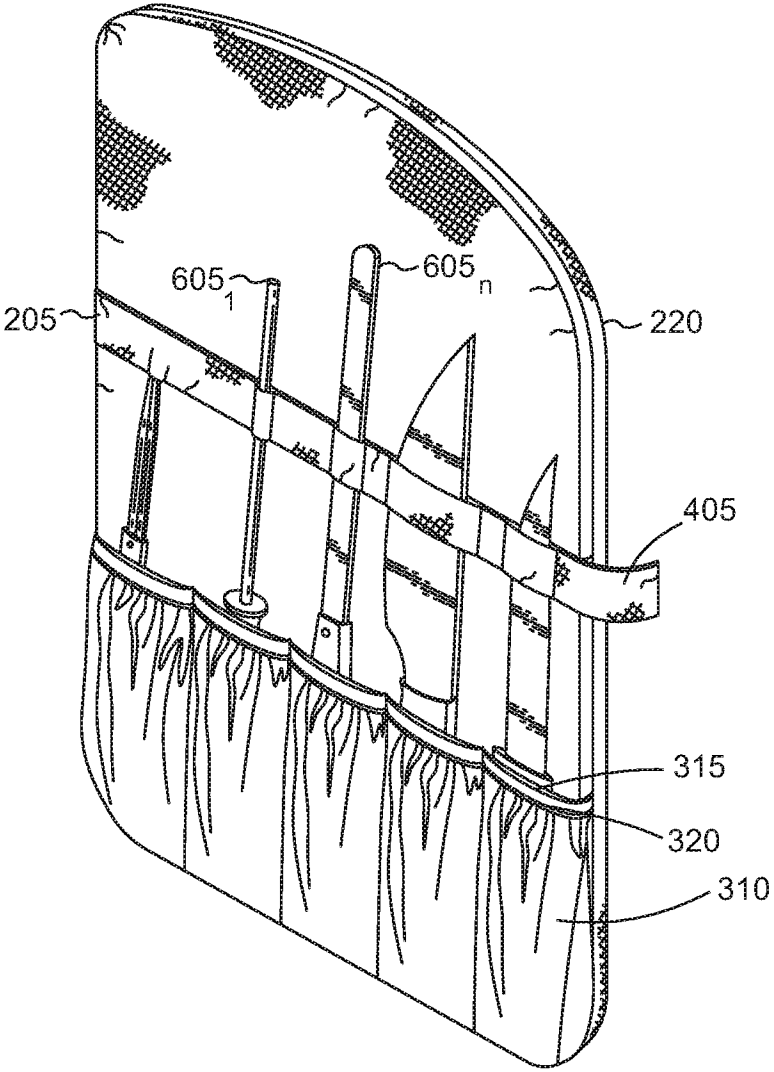
FIG. 6 shows an illustrative representation of knives being secured in place using the flap's pouches and strap fastener.

FIG. 4 shows an illustrative representation in which the flap 220 includes extra material 405 to accommodate the surface area occupied by kitchen utensils inside the pouches 310 (not shown in FIG. 4). FIGS. 4-6 show the movable flap alone for clarity in exposition, but it should be understood that the flap may be connected to the remainder of the backpack as shown in FIGS. 1-3.

The extra material 405 extends beyond the base fastener (not shown) positioned on the base 325 of the flap 220. When the strap fastener 205 is securing multiple bulgy utensils in each pouch, the additional material enables the strap to fully extend the length of the flap and still appropriately secure any utensils stored in the last pouch 410. That is, the extra material helps make sure the strap fastener will not be too short to cover the final utensil.

FIG. 5 shows an illustrative representation in which the strap fastener 205 can removably lift from the base fastener 505. The fastener used may be a hook-and-loop fastener 510, such as Velcro®. In typical implementations, the base fastener may extend a horizontal length of the base 325 of the flap 220, and the strap fastener has greater length than the base fastener to accommodate the space occupied by kitchen utensils, as discussed above. When the strap fastener is lifted from the base fastener, the user may insert various utensils, knives, wooden spoons, etc. through the openings 335 and inside the respective pouches 310, as illustrative represented by numeral 515. The user may then fasten the inserted utensils by engaging the hooks on the strap fastener against the loops on the base fastener. The strap fastener may engage the empty spaces in between the knives.

FIG. 6 shows an illustrative representation in which various kitchen knives 605 are inserted into the respective pouches 310. The upper blade portions of the knives are better secured in place using the strap and base fasteners 205, 505. As discussed above, the extra material 405 is available to accommodate the additional space taken up by the utensils and enables the strap fastener to secure the utensil stored in the last pouch.

Figure 7:
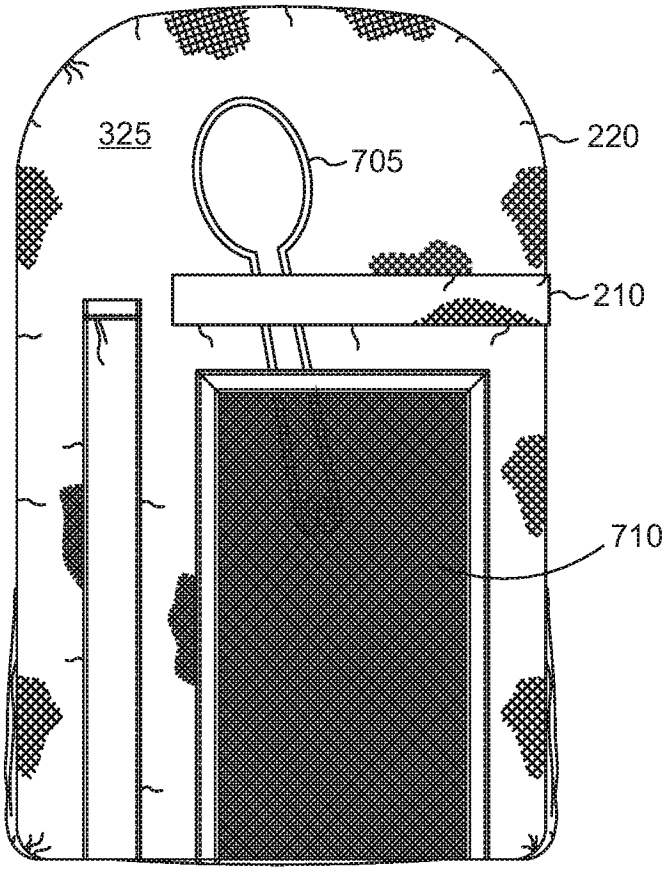
FIG. 7 shows an illustrative representation of a kitchen utensil secured in place using another implementation of the strap fastener and a netted pouch.

FIG. 7 shows an illustrative representation in which a reverse side of the flap 220 is shown, as originally shown in FIG. 2. The reverse side likewise has a strap fastener 210 which is positioned above a netted pouch 710 for larger utensil items, such as wooden spoon 705 or clever/butcher knives (not shown). Although not shown, the strap fastener may likewise be secured in between a hinge fabric 345 (FIG. 3) and the base of the flap 220. In this implementation, the strap fastener is positioned a lesser distance from the top of the netted pouch 710 relative to the pouches shown in FIGS. 3-6 since the head of larger utensils may typically stop at the top of the fastener.

Various implementations are available for the present backpack that employs a strap fastener to secure utensils in place. One implementation includes a backpack having multiple compartments and storage mechanisms to store kitchen utensils, comprising: a movable flap having a base and on which are multiple pouches arranged on a bottom portion thereof, each pouch configured to hold one or more kitchen utensils; a base fastener positioned above the pouches and on the base of the movable flap; and a strap fastener that is secured to an end of the movable flap and which extends horizontally across the movable flap and aligns and mates with the base fastener, wherein the kitchen utensils overlay with the base fastener and are further secured in place when the strap fastener mates with the base fastener and the kitchen utensils are positioned between the base and strap fasteners.

In another example, each pouch has an elastic strap positioned at a top thereof to provide greater grip and secure respective kitchen utensils in place. As another example, the pouches are adjacently and laterally aligned on the movable flap. As another example, the base fastener is a strip on the base of the movable flap, and wherein the strip of the base fastener extends fully from one horizontal end to an opposite horizontal end of the movable flap. As another example, the strap fastener likewise extends fully from one horizontal end to the opposite horizontal end. As another example, the strap fastener extends beyond the opposite horizontal end such that the strap fastener is longer than the base fastener to accommodate occupied space by the kitchen utensils. In another example, the backpack further comprises a hinge fabric that attaches to the movable flap and a structure of the backpack and which enables the movable flap to laterally rotate. As another example, the strap fastener is secured between the movable flap and the hinge fabric. In another example, the backpack further comprises a stagnant flap which includes compartments for storing utensils, and wherein the hinge fabric attaches to and extends from the stagnant flap to the movable flap. In another example, the base and strap fasteners are hook-and-loop fasteners. In another example, the hook-and-look fasteners are Velcro®.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed:

1. A backpack having multiple compartments and storage mechanisms to store kitchen utensils, comprising:

a movable flap having a base and on which are multiple pouches arranged on a bottom portion thereof, each pouch configured to hold one or more kitchen utensils;

a hinge fabric that attaches to the movable flap and a structure of the backpack and which enables the movable flap to laterally rotate;

a base fastener positioned above the pouches and on the base of the movable flap; and a strap fastener that is secured to an end of the movable flap and which extends horizontally across the movable flap and aligns and mates with the base fastener, in which the strap fastener is secured between the movable flap and the hinge fabric, and wherein the kitchen utensils overlay with the base fastener and are further secured in place when the strap fastener mates with the base fastener and the kitchen utensils are positioned between the base and strap fasteners.

2. The backpack of claim 1, wherein each pouch has an elastic strap positioned at a top thereof to provide greater grip and secure respective kitchen utensils in place.

3. The backpack of claim 1, wherein the pouches are adjacently and laterally aligned on the movable flap.

4. The backpack of claim 1, wherein the base fastener is a strip on the base of the movable flap, and wherein the strip of the base fastener extends fully from one horizontal end to an opposite horizontal end of the movable flap.

5. The backpack of claim 4, wherein the strap fastener likewise extends fully from one horizontal end to the opposite horizontal end.

6. The backpack of claim 5, wherein the strap fastener extends beyond the opposite horizontal end such that the strap fastener is longer than the base fastener to accommodate occupied space by the kitchen utensils.

7. The backpack of claim 1, further comprising a stagnant flap which includes compartments for storing utensils, and wherein the hinge fabric attaches to and extends from the stagnant flap to the movable flap.

8. The backpack of claim 1, wherein the base and strap fasteners are hook-and-loop fasteners.

9. A backpack having multiple compartments and storage mechanisms to store kitchen utensils, comprising:

a movable flap having a base and on which are multiple pouches arranged on a bottom portion thereof, each pouch configured to hold one or more kitchen utensils;

a base fastener positioned above the pouches and on the base of the movable flap; and a strap fastener that is secured to an end of the movable flap and which extends horizontally across the movable flap and aligns and mates with the base fastener, wherein the kitchen utensils overlay with the base fastener and are further secured in place when the strap fastener mates with the base fastener and the kitchen utensils are positioned between the base and strap fasteners, wherein the base fastener is a strip on the base of the movable flap, and wherein the strip of the base fastener extends fully from one horizontal end to an opposite horizontal end of the movable flap, and wherein the strap fastener extends beyond the opposite horizontal end and the base fastener's end such that the strap fastener is longer than the base fastener and the moveable flap to accommodate occupied space by the kitchen utensils.

* * * * *